US007237546B2

(12) United States Patent
Nozato

(10) Patent No.: US 7,237,546 B2
(45) Date of Patent: Jul. 3, 2007

(54) BALL THROWING MACHINE

(75) Inventor: Kazu Nozato, Osaka (JP)

(73) Assignee: Toa Sports Machine Incorporated, Osaka (JP)

( * ) Notice: Subject to any disclaimer, the term of this patent is extended or adjusted under 35 U.S.C. 154(b) by 0 days.

(21) Appl. No.: 10/550,391

(22) PCT Filed: May 17, 2004

(86) PCT No.: PCT/JP2004/006636

§ 371 (c)(1),
(2), (4) Date: Sep. 22, 2005

(87) PCT Pub. No.: WO2005/065788

PCT Pub. Date: Jul. 21, 2005

(65) Prior Publication Data

US 2006/0169267 A1 Aug. 3, 2006

(30) Foreign Application Priority Data

Dec. 26, 2003 (JP) ..... 2003-434571

(51) Int. Cl.
*F41B 4/00* (2006.01)

(52) U.S. Cl. ..... 124/78

(58) Field of Classification Search ..... 124/6, 124/78

See application file for complete search history.

(56) References Cited

U.S. PATENT DOCUMENTS 1,204,468 A * 11/1916 Marty ..... 124/6
4,423,717 A * 1/1984 Kahelin ..... 124/78
6,152,126 A 11/2000 Smith et al. ..... 124/78
6,443,140 B1 * 9/2002 Crews et al. ..... 124/78

FOREIGN PATENT DOCUMENTS

| | | |
|---|---|---|
| JP | 55-70173 | 5/1980 |
| JP | 60-25670 | 2/1985 |
| JP | 5-91755 | 12/1993 |
| JP | 2001-218883 | 8/2001 |

OTHER PUBLICATIONS

International Search Report English Language Abstracts of the Above Japanese References.

* cited by examiner

*Primary Examiner*—John A. Ricci
(74) *Attorney, Agent, or Firm*—Pillsbury Winthrop Shaw Pittman, LLP

(57) ABSTRACT

The formation of a ball throwing machine is facilitated and the accuracy of the direction in which balls are thrown by the ball throwing machine is improved. The ball throwing machine (1) comprises a support body (4) mountable on the ground (3), a pair of rotary shafts (6, 6) supported by the support body (4) so that they are rotatable around their own parallel axes (5), and a pair of rotary wheels (7, 7) fixed on the rotary shafts (6) concentrically with the latter. A ball (2) fed between the outer peripheral surfaces (10, 10) of the two rotary wheels (7, 7) rotating in opposite directions (C, D) is nipped between the outer peripheral surfaces (10, 10) and accelerated and thrown outward. The support body comprises a support body main body (15) mountable on the ground (3), and a support pipe (16) supported by the support body main body (15) to linearly extend so as to support the rotary shafts (6) in a state in which the rotary shafts (6) extend through the support pipe (16) in a direction orthogonal to the longitudinal direction of the support pipe (16).

1 Claim, 6 Drawing Sheets

BALL THROWING MACHINE

CROSS REFERENCE TO RELATED APPLICATIONS

This application is the National Phase of International Application PCT/NL02/00559 filed Aug. 23, 2002 which designated the U.S., and that International Application was published under PCT Article 21(2) in English, and further claims priority to Japanese application No. 2003-434571, filed Dec. 26, 2003, the contents of both of which are incorporated herein in their entirety by reference.

TECHNICAL FIELD

The present invention relates to a ball throwing machine used for pitching practice, catching practice or the like in ball games including baseball and softball, wherein a ball is accelerated by being held between the outer peripheral surfaces of two rotary wheels which are rotating in opposite directions, whereby the ball can be thrown. More particularly, the invention relates to a construction for a support body for supporting said two rotary wheels.

BACKGROUND ART

Such pitching machine is described in Patent Document 1 denoted below. According to this document, the ball throwing machine comprises a support body mountable on the ground, a pair of rotary shafts supported by said support body so that they are rotatable around their own parallel axes, a pair of rotary wheels fixed on said rotary shafts concentrically with the latter and juxtaposed radially of said rotary shafts, an electric motor supported by said support body to enable said two rotary wheels to be driven for rotation, and an operatively connecting means for operatively connecting said two rotary wheels to said electric motor. Further, said support body comprises a support body main body which is a carriage mountable on the ground, and a support box body supported on the upper surface of said support body main body and made of metal plate in box form to support said rotary shafts and to receive said operatively connecting means.

When it is desired to make said ball throwing machine perform ball throwing action, said electric motor is driven. Thereupon, said two rotary wheels are rotated in opposite directions in operative association with the driving of the electric motor and through said operatively connecting means and said rotary shafts. And, a ball is fed between the outer peripheral surfaces of said two rotary wheels. Thereupon, said ball is nipped between the outer peripheral surfaces and accelerated and thrown outward.

Patent Document 1: Japanese Paten Laid-Open No. 2001-218883.

DISCLOSURE OF THE INVENTION

Problems to be Solved by the Invention

In this connection, the support box body in said conventional art is made of metal plate and the forming operation therefor is troublesome. Further, said operatively connecting means is received in the inner space of said support box body, said inner space being narrow. Therefore, the operation of attaching said operatively connecting means to said rotary shafts and electric motor during the assembling of said ball throwing machine tends to be troublesome. Thus, the forming operation of said ball throwing machine has become troublesome as a whole.

On the other hand, if it is desired to secure sufficient rigidity for said support box body, it may be contemplated to increase the thickness of the metal plate or to add reinforcing members. With such arrangement, however, said support box body will become heavier, and so will the ball throwing machine. Therefore, the handling of the ball throwing machine, such as moving the latter, will become troublesome.

Accordingly, in the prior art, the chief aim is placed on keeping said support box body light weight. In this case, however, the rigidity of said ball throwing machine will become insufficient, leading to the following drawbacks. That is, in the ball throwing action of the ball throwing machine, when a ball is nipped between the outer peripheral surfaces of the two rotary wheels, a high degree of reaction from this ball is imparted to each of said rotary shafts through the rotary wheels. Thereupon, there is the danger of said support box body supporting these rotary shafts being flexed under said reaction. If such flexure occurs, the accuracy of the direction of throwing of balls lowers.

MEANS FOR SOLVING PROBLEMS

The invention has been accomplished with the above in mind, and an object thereof is to facilitate the formation of ball throwing machines.

Another object of the invention is to improve the accuracy of the direction in which balls are thrown by the ball throwing machine.

The invention provides a ball throwing machine comprising a support body mountable on the ground, a pair of rotary shafts supported by said support body so that they are rotatable around their own parallel axes, a pair of rotary wheels fixed on said rotary shafts concentrically with the latter, an electric motor supported by said support body to enable said two rotary wheels to be driven for rotation, and an operatively connecting means for operatively connecting said two rotary wheels to said electric motor, the arrangement being such that said two rotary wheels are rotated in opposite directions in operative association with the driving of the electric motor and through said operatively connecting means and said rotary shafts, and a ball fed between the outer peripheral surfaces of said two rotary wheels is nipped between the outer peripheral surfaces and accelerated and thrown outward, wherein, said support body comprises a support body main body mountable on the ground, and a support pipe supported by said support body main body to linearly extend so as to support the rotary shafts in a state in which the rotary shafts extend through the support pipe in a direction orthogonal to the longitudinal direction of the support pipe.

In addition, in said invention, said electric motor may be supported by said support pipe.

Further, in said invention, said operatively connecting means may be disposed outside said support pipe.

Further, in said invention, any sections of said support pipe taken longitudinally thereof may be rectangles of the same shape and size.

Further, in said invention, said support body main body may comprise a support frame mountable on the ground, pillars projecting upward from said support frame, and a pivot shaft for pivotally supporting said support pipe on said pillars to allow said support pipe to turn around the axis of the pivot shaft, wherein said support pipe may be three-dimensionally orthogonal to the axis of said pivot shaft.

EFFECTS OF THE INVENTION

The effects of the invention are as follows.

The invention provides a ball throwing machine comprising a support body mountable on the ground, a pair of rotary shafts supported by said support body so that they are rotatable around their own parallel axes, a pair of rotary wheels fixed on said rotary shafts concentrically with the latter, an electric motor supported by said support body to enable said two rotary wheels to be driven for rotation, and an operatively connecting means for operatively connecting said two rotary wheels to said electric motor, the arrangement being such that said two rotary wheels are rotated in opposite directions in operative association with the driving of the electric motor and through said operatively connecting means and said rotary shafts, and a ball fed between the outer peripheral surfaces of said two rotary wheels is nipped between the outer peripheral surfaces and accelerated and thrown outward, wherein, said support body comprises a support body main body mountable on the ground, and a support pipe supported by said support body main body to linearly extend so as to support the rotary shafts in a state in which the rotary shafts extend through the support pipe in a direction orthogonal to the longitudinal direction of the support pipe.

Therefore, the main section of the support body which supports the rotary wheels through said rotary shafts is composed of a part of simple construction which is in the form of a support pipe. And, since such support pipe is easy to form, the ball throwing machine is also easy to form.

Furthermore, said rotary shafts extend through the support pipe and are supported by the latter. Therefore, it is possible to support said rotary shafts by said support pipe more directly. In other words, when said rotary shafts are to be supported by the support pipe, there is no need for a separate large-sized part, such as a bracket. Therefore, the arrangement of said ball throwing machine is simplified and the formation thereof is further facilitated.

Further, said support pipe is a structure high in strength and rigidity, and the rotary shafts are, as described above, supported more directly by said support pipe. Therefore, said rotary shafts are supported with high strength by the support pipe. Thus, in the ball throwing action of the ball throwing machine, even when a high degree of reaction from a ball nipped between the outer peripheral surfaces of the two rotary wheels is imparted to each of the rotary shafts through the rotary wheels, the support pipe supporting the rotary shafts is prevented from flexing. Therefore, the accuracy of the direction in which balls are thrown by the ball throwing machine is improved.

Further, said rotary shafts extend through said support pipe. Therefore, the rotary shafts have at least their part externally covered by said support pipe; they are suppressed from being exposed outside. Therefore, by the amount corresponding thereto, it becomes more difficult for the rotary shafts to be seen from outside. Thus, this improves the external appearance of the ball throwing machine and is also advantageous from the standpoint of safety.

In addition, in said invention, said electric motor may be supported by said support pipe.

If said electric motor is so supported, the rotary shafts, rotary wheels, electric motor, operatively connecting means, and support pipe become a single assembly. Accordingly, at the time of formation of the ball throwing machine, this assembly is independently built and then the assembly can be attached to the support body main body. Furthermore, the rotary shafts extend through said support pipe and are supported by the latter, as described above. Therefore, the rotary shafts and the support pipe are respectively of compact construction. Thus, since said assembly itself is of compact construction, the attachment of said assembly to said support body main body is further facilitated. As a result, the formation of said ball throwing machine is further facilitated.

Further, in said invention, said operatively connecting means may be disposed outside said support pipe.

If said operatively connecting means is so disposed, the operation of attaching said operatively connecting means to the rotary shafts and electric motor is facilitated, as compared when said operatively connecting means is received in the inner space of the support pipe. Thus, the formation of the ball throwing machine is further facilitated.

Further, in said invention, said operatively connecting means may be disposed outside said support pipe.

If the operatively connecting means is so disposed, when the rotary shafts and electric motor are to be supported by said support pipe, they can be supported on the flat surfaces of the walls constituting said support pipe. Thus, this support construction is further simplified, and by the amount corresponding thereto, the formation of the ball throwing machine is further facilitated.

Further, in said invention, said support body main body may comprise a support frame mountable on the ground, pillars projecting upward from said support frame, and a pivot shaft for pivotally supporting said support pipe on said pillars to allow said support pipe to turn around the axis of the pivot shaft, wherein said support pipe may be three-dimensionally orthogonal to the pivot shaft.

If this arrangement is employed, the direction of throwing of balls can be changed to a desired one by turning said support pipe together with said two rotary wheels to a desired position around the axis.

Further, the axes of said support pipe and said pivot shaft are three-dimensionally intersected, as described above. Therefore, the pivotal support of the support pipe onto said pillars by the support body main body can be made more directly than if the axes of the support pipe and pivot shaft are estranged from each other to make it necessary to provide a separate joining member to join the support pipe and pivot shaft to each other. In other words, the pivotal support of the support pipe onto the support body main body can be made more directly.

Thus, first, the arrangement of the ball throwing machine is simplified and the formation thereof is facilitated. Secondly, the pivotal support of the support pipe onto the support body main body can be firmly made and the support strength with which the support pipe is supported by the support body main body is improved. Therefore, the accuracy of the throwing of balls by the ball throwing machine is improved.

DESCRIPTION OF THE REFERENCE CHARACTERS

Figure 1:
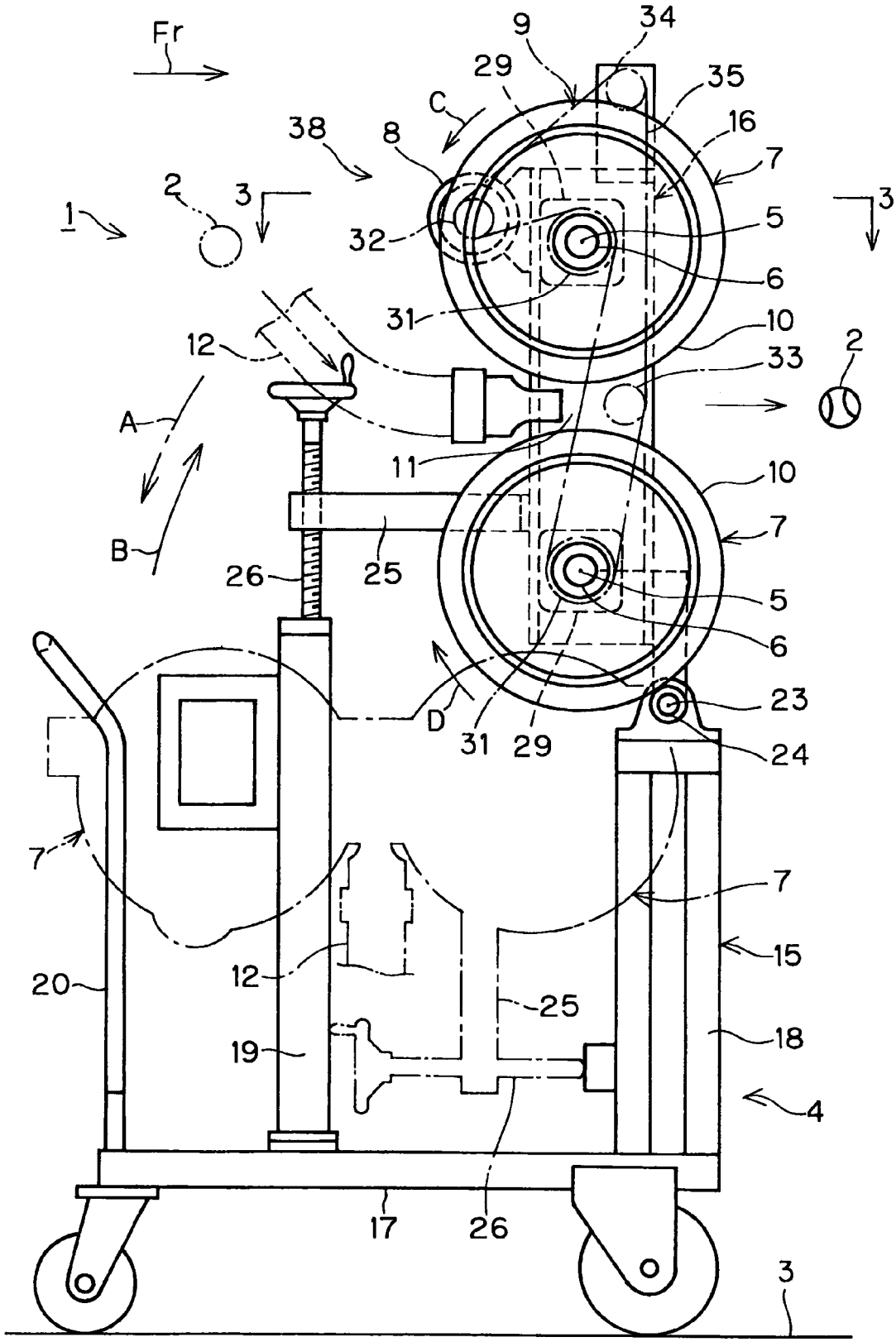
FIG. 1, showing a first embodiment 1, is an overall side view.

2 Ball
3 Ground
4 Support body
5 Axis
6 Rotary shaft
7 Rotary wheel
8 Electric motor
9 Operatively connecting means
10 Outer peripheral surface
11 Space
12 Chute
15 Support body main body
16 Support pipe
16*a* First opposed wall
16*b* Second opposed wall
17 Support frame
18 Pillar
19 Pillar
20 Hand-push section
38 Assembly
43 Axis
44 Pivot shaft
A Forward turning movement
B Return turning movement
C Reverse rotation
D Reverse rotation

BEST MODE FOR CARRYING OUT THE INVENTION

In order to achieve the object of facilitating the formation of ball throwing machines and to improve the accuracy of the direction in which balls are thrown by a ball throwing machine, the best mode for carrying out the invention is as follows.

That is, a ball throwing machine comprises a support body mountable on the ground, a pair of rotary shafts supported by said support body for rotation around their respective parallel axes, a pair of rotary wheels fixed on said rotary shafts concentrically with the latter and juxtaposed radially of said rotary shafts, an electric motor supported by said support body to enable said two rotary wheels to be driven for rotation, and an operatively connecting means for operatively connecting said two rotary wheels to said electric motor.

And, said two rotary wheels are reversely rotated through said operatively connecting means and rotary shafts in operative association with the driving of the electric motor, and a ball fed between the outer peripheral surfaces of the two rotary wheels is nipped between these peripheral surfaces and accelerated to be thrown outward.

The support body comprises a support body main body mountable on the ground, and a support pipe supported by said support body main body to linearly extend so as to support the rotary shafts in a state in which the rotary shafts extend through the support pipe in a direction orthogonal to the longitudinal direction of the support pipe. Any sections of said support pipe taken longitudinally thereof are rectangles of the same shape and size.

Embodiment 1

To describe the invention in more detail, a description will be given of the embodiment 1 with reference to FIGS. 1–3 of the attached drawings.

Figure 2:
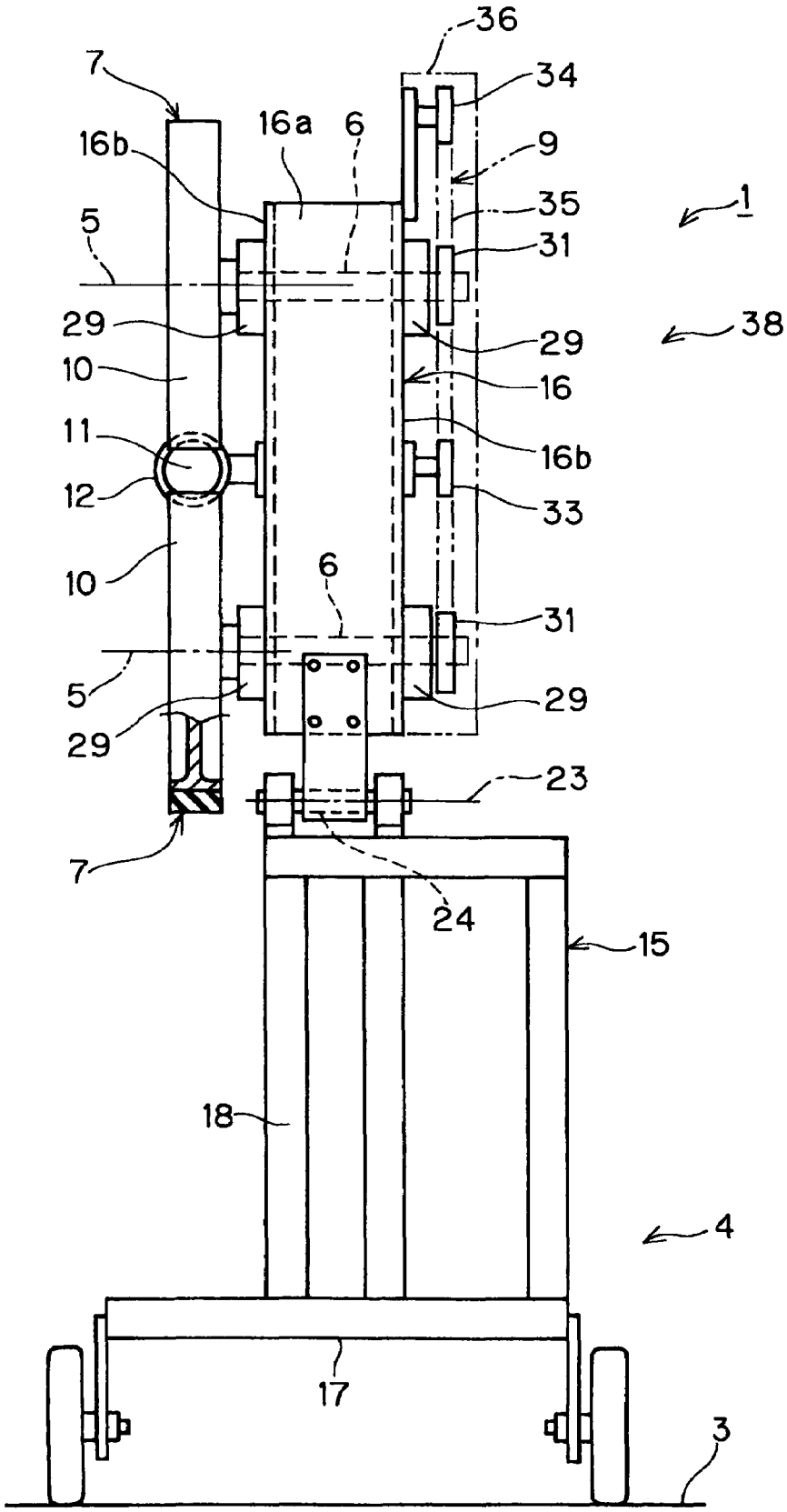
FIG. 2, showing the first embodiment 1, is an overall front view.
Figure 3:
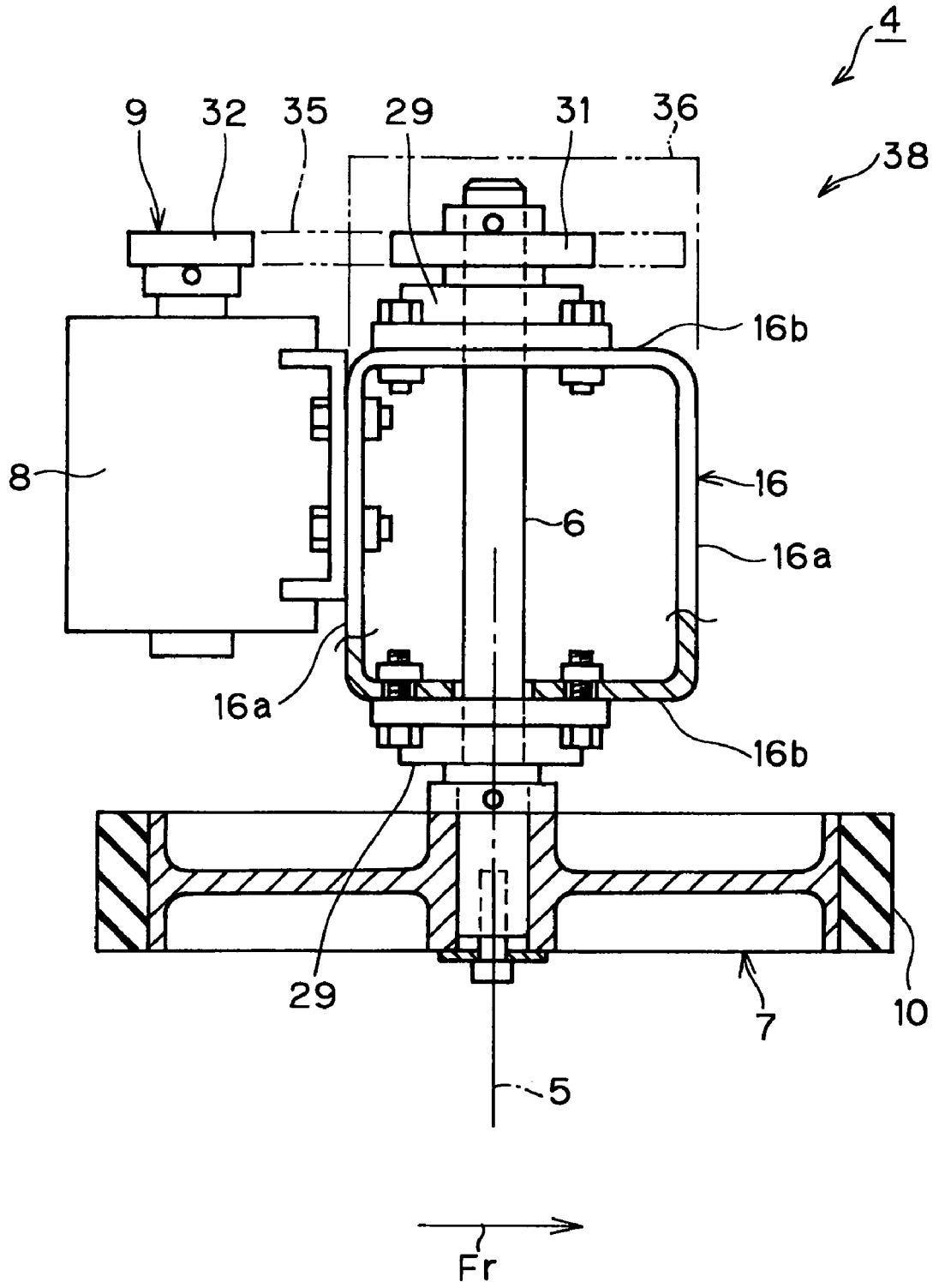
FIG. 3, showing the first embodiment 1, is a sectional view taken along the line 3—3 in FIG. 1.

In FIGS. 1–3, the reference character 1 denotes a ball throwing machine, and an arrow Fr indicates the forward direction or the direction in which balls 2 are thrown by the ball throwing machine 1. The ball throwing machine 1 is used for pitching practice, catching practice or the like in ball games including baseball and softball.

The ball throwing machine 1 comprises a support body 4 mountable on the ground 3 used for ball games, a pair of rotary shafts 6, 6 supported by said support body 4 so that they are rotatable around their own parallel axes 5, a pair of rotary wheels 7, 7 fixed on said rotary shafts 6 concentrically with the latter and juxtaposed radially of said rotary shafts 6, an electric motor 8 supported by said support body 4 to enable said two rotary wheels 7, 7 to be driven for rotation, and an operatively connecting means 9 for operatively connecting said two rotary wheels 7, 7 to said electric motor 8 through said two rotary shafts 6, 6, and a chute 12 supported by said support body 4 and adapted to feed a ball 2 into a space 11 between the outer peripheral surfaces 10, 10 of said two rotary wheels 7, 7.

Said support body 4 comprises a support body main body 15 mountable on said ground 3, and a support pipe 16 supported by said support body main body 15 and supporting the rotary shafts 6. The support body main body 15 comprises a support frame 17 which is a carriage mountable on said ground 3 and movable to an optional position, a pair of pillars 18 and 19, front and rear, projecting upward from said support fame 17, and a hand-push section 20 projecting from the rear end of said support fame 17, the rear pillar 19 being removably attached to said support frame 17 by fasteners.

The support pipe 16 longitudinally linearly extends and any sections taken longitudinally thereof are rectangles of the same shape and size. More specifically, any sections of said support pipe are squares, and the support pipe 16 is a square pipe made of metal. The support pipe 16 is usually a standardized article on the market.

The lower end of the support pipe 16 is pivotally supported by a pivot shaft 24 having an axis 23 extending left and right with respect to the upper end of the front pillar 18. And, said support pipe 16 is pivotally supported on the upper end of said front pillar 18 so as to be capable of forward and return turning movements A and B rearwardly downward around the axis 23. A support arm 25 projects rearward from a vertical intermediate portion of said support pipe 16, and a screw jack type jack bolt 26 is installed for supporting the projecting end of the support arm 25 on the upper end of the rear pillar 19.

The support pipe 16 is supported by the support body main body 15 through said pivot shaft 24, support arm 25, and jack bolt 26, whereby the support pipe 16 is held in a vertically extending erected position. Turning said jack bolt 26 makes it possible to incline said support pipe 16 at an optional angle of inclination as seen in a side view (FIG. 1) of the ball throwing machine 1.

The support pipe 16 has a pair of first opposed walls 16*a*, 16*a* which are opposed to each other in a direction orthogonal to the longitudinal direction thereof, and a pair of second opposed walls 16*b*, 16*b* which integrally join the widthwise end edges of the first opposed walls 16*a*, 16*a*. The first opposed walls 16*a*, 16*a* are disposed to oppose each other in a front-rear direction, while the second opposed walls 16*b*, 16*b* are disposed to oppose each other in a left-right direction.

The rotary shafts 6 are disposed in a vertically spaced relation to each other and extend widthwise of said first opposed walls 16*a* to pass through said second opposed walls 16*b*, 16*b* at right angles and are supported by bearings 29 at both ends with respect to the second opposed walls 16*b*, 16*b*.

The two rotary wheels 7, 7 are disposed one above the other outward on one side (outward on the right side) of the support pipe 16 and fixed at one of the respective ends of said rotary shafts 6. Further, said operatively connecting means 9 is disposed outward on the other side (outward on the left side) of the support pipe 16. The operatively connecting means 9 comprises driven pulleys 31 fixed to the other ends of the rotary shafts 6, a drive pulley 32 fixed to the output shaft of the electric motor 8, an idle pulley 33 and a tension pulley 34 which are supported by the support pipe 16, an endless belt 35 entrained around these pulleys 31 through 34, and a cover body 36 covering substantially all of the components, the driven pulley 31, idle pulley 33, tension pulley 34, and endless belt 35, from outside.

When said ball throwing machine 1 is to be operated to throw balls, said electric motor 8 is driven. Thereupon, the two rotary wheels 7, 7 are rotated in opposite directions C and D in operative association with the driving of the electric motor 8 and through the operatively connecting means 9 and rotary shafts 6. And, a ball 2 is fed between the outer peripheral surfaces 10, 10 of the two rotary wheels 7, 7 through said chute 12. Thereupon, the ball is nipped between the outer peripheral surfaces 10, 10 and accelerated and is thrown outward toward a desired direction.

In the above case, if the jack bolt 26 is turned to vary the angle of inclination of the support pipe 16, then correspondingly thereto the direction of throwing of balls by the two rotary wheels 7, 7 is made variable. Further, the rotation speed of each rotary wheel 7 is variable.

When the ball throwing machine 1 is not used or is transferred, the rear pillar 19 is removed from the support frame 17. Further, said support pipe 16, together with the rotary wheels 7, is turned forward as indicated by A around the axis 23. Thereupon, said rotary shafts 6, rotary wheels 7, electric motor 8, operatively connecting means 9, and support pipe 16 are received as a single assembly 38 in a space defined between the front pillar 18 and the hand-push section 20 (shown in alternate long and short dash lines in FIG. 1). Thereby, the ball throwing machine 1 can be compacted in size.

According to the above arrangement, the support body 4 is provided with the support body main body 15 mountable on the ground 3, and the support pipe 16 supported by said support body main body 15 to linearly extend so as to support the rotary shafts 6 in a state in which the rotary shafts extend through the support pipe in a direction orthogonal to the longitudinal direction of the support pipe.

Therefore, the main section of the support body 4 supporting the rotary wheels 7 through the rotary shafts 6 is composed of the support pipe 16, a part of simple construction. And, since such support pipe 16 is easy to form, the ball throwing machine is also easy to form.

Furthermore, the rotary shafts 6 extend through the support pipe 16 and are supported by the latter. Therefore, it is possible to support said rotary shafts 6 by said support 16 pipe more directly. In other words, when said rotary shafts 6 are to be supported by the support pipe 16, there is no need for a separate large-sized part, such as a bracket. Therefore, the arrangement of said ball throwing machine 1 is simplified and the formation thereof is further facilitated.

Further, said support pipe 16 is a structure high in strength and rigidity, and the rotary shafts 6 are, as described above, supported more directly by said support pipe 16. Therefore, said rotary shafts 6 are supported with high strength by the support pipe 16. Thus, in the ball throwing action of the ball throwing machine 1, even when a high degree of reaction from a ball 2 nipped between the outer peripheral surfaces 10, 10 of the two rotary wheels 7, 7 is imparted to each of the rotary shafts 6 through the rotary wheels, the support pipe 16 supporting the rotary shafts 6 is prevented from flexing. Therefore, the accuracy of the direction in which balls are thrown by the ball throwing machine 1 is improved.

Further, said rotary shafts 6 extend through said support pipe 16. Therefore, rotary shafts 6 have at least their part externally covered by said support pipe 16; they are suppressed from being exposed outside. Thus, by the amount corresponding thereto, it becomes more difficult for the rotary shafts 6 to be seen from outside. Therefore, this improves the external appearance of the ball throwing machine 1 and is also advantageous from the standpoint of safety.

Further, as described above, the electric motor 8 is supported by the support pipe 16.

Therefore, the rotary shafts 6, rotary wheels 7, electric motor 8, operatively connecting means 9, and support pipe 16 become a single assembly 38. Thus, at the time of formation of the ball throwing machine 1, this assembly 38 is independently built and then the assembly 38 can be attached to the support body main body 15. Furthermore, the rotary shafts 6 extend through said support pipe 16 and are supported by the latter, as described above. Therefore, the rotary shafts 6 and the support pipe 16 are respectively of compact construction. Thus, since said assembly 38 itself is of compact construction, the attachment of said assembly 38 to said support body main body 15 is further facilitated. As a result, the formation of said ball throwing machine 1 is further facilitated.

Further, said operatively connecting means 9 is disposed outside said support pipe 16, as described above.

Therefore, the operation of attaching said operatively connecting means 9 to the rotary shafts 6 and electric motor 8 is facilitated, as compared when said operatively connecting means 9 is received in the inner space of the support pipe 16. Thus, the formation of the ball throwing machine 1 is further facilitated.

Further, any sections of said support pipe 16 taken longitudinally thereof are rectangles of the same shape and size, as described above.

Therefore, when the rotary shafts 6 and electric motor 8 are to be supported by said support pipe 16, they can be supported on the flat surfaces of the walls constituting said support pipe 16. Thus, this support construction is simplified, and by the amount corresponding thereto, the formation of the ball throwing machine 1 is further facilitated.

In addition, the above description has been given of the illustrated examples, and said support body 4 may be of the type adapted to be fixed on the ground 3. Further, said support pipe 16 may be a round pipe.

Figure 4:
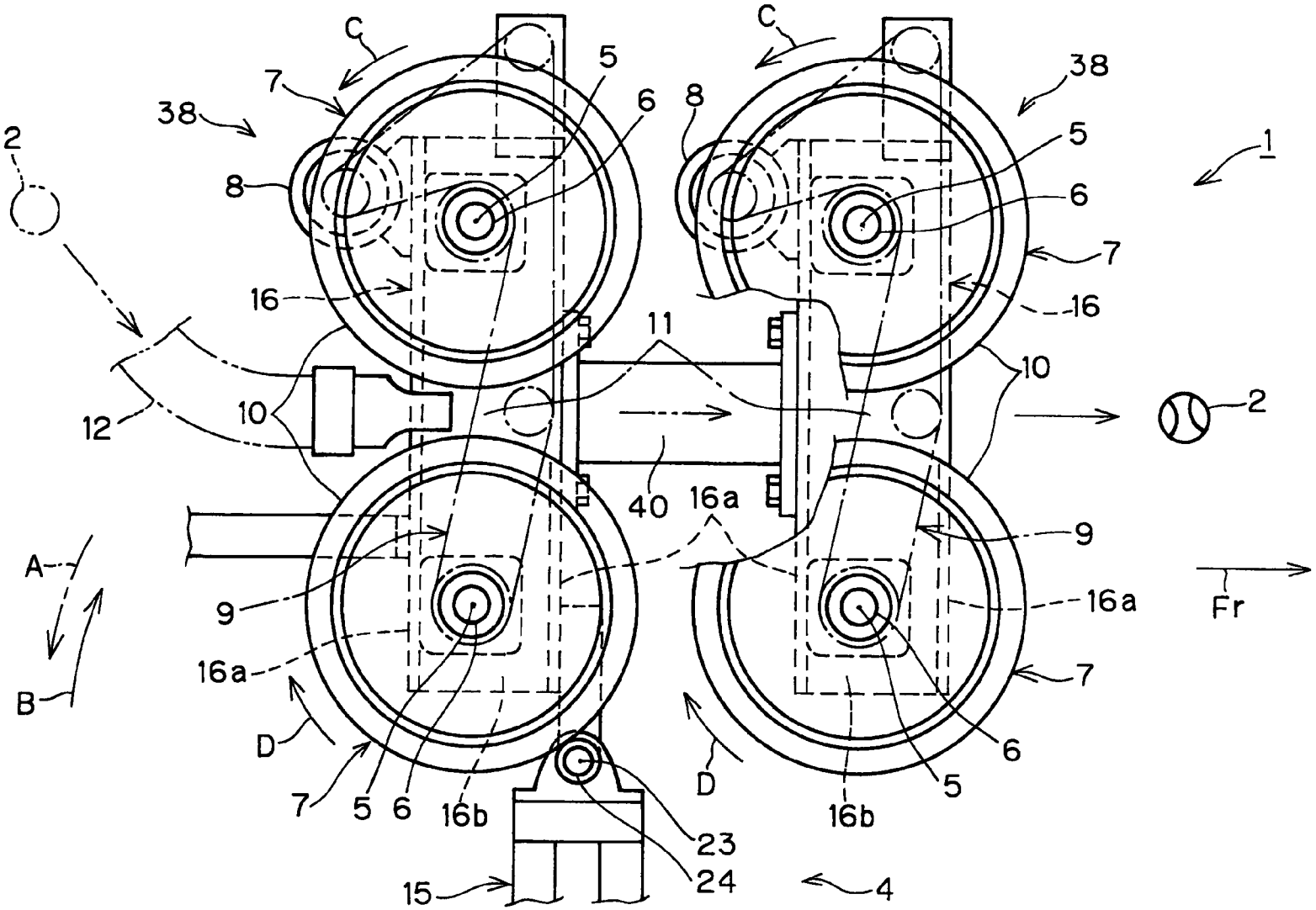
FIG. 4, showing a second embodiment 2, is a broken-away view corresponding to the enlarged view of FIG. 1.
Figure 5:
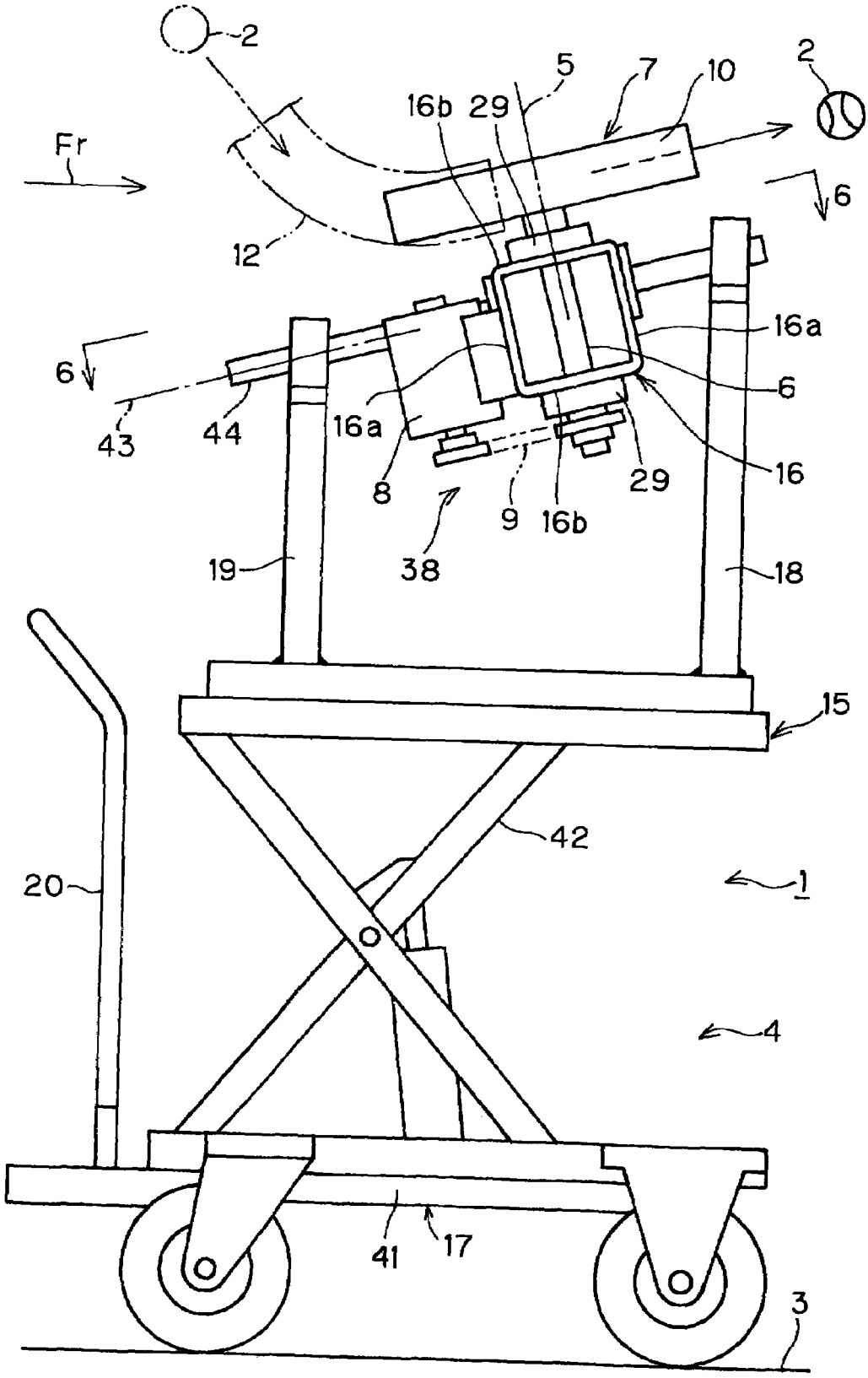
FIG. 5, showing a third embodiment 3, is an overall side view corresponding to FIG. 1.
Figure 6:
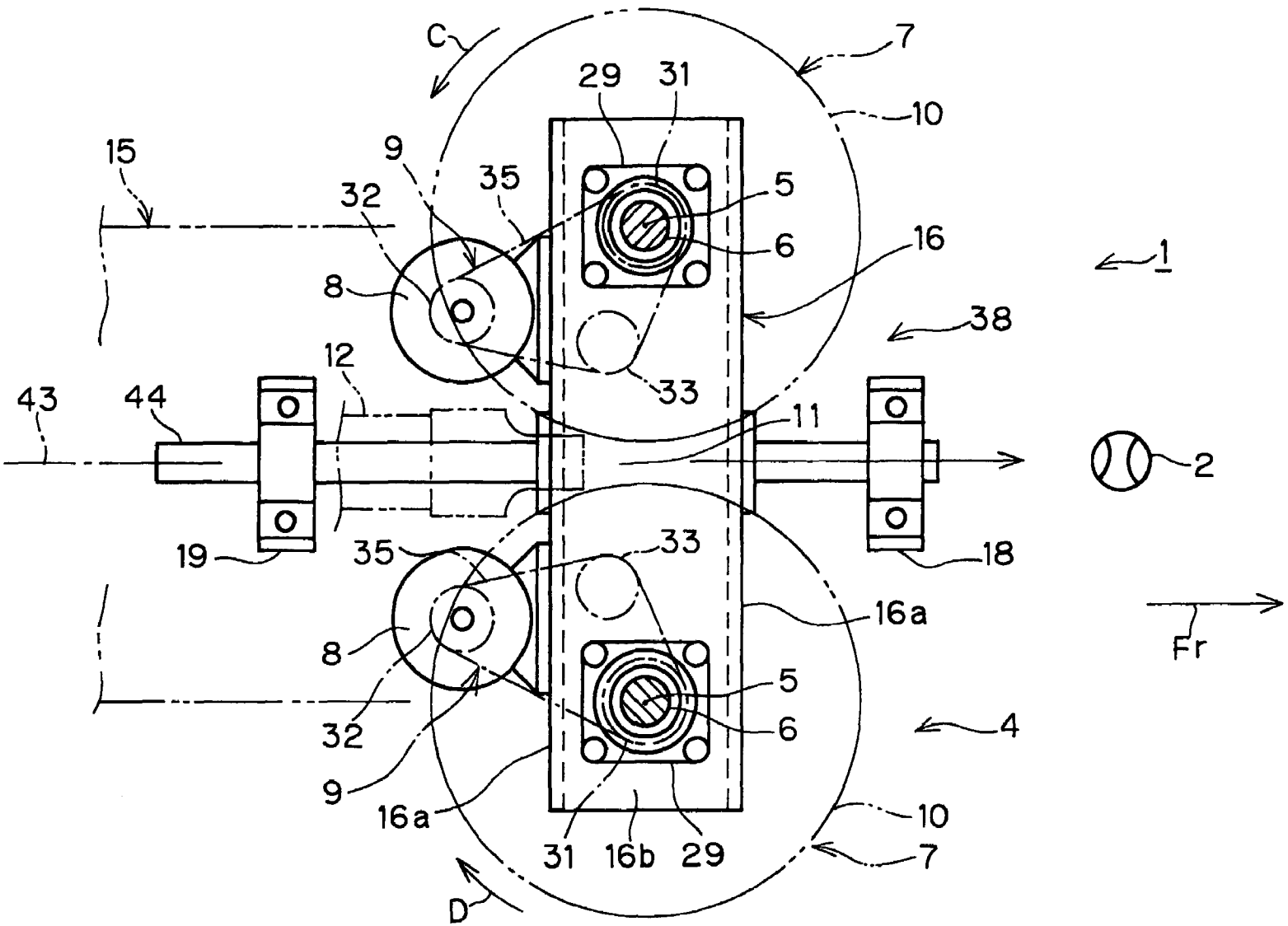
FIG. 6, showing the third embodiment 3, is a view taken along the line 6—6 in FIG. 5.

FIGS. 4 through 6 referred to below show embodiments 2 and 3. These embodiments have many points in common with the embodiment 1 in respect of arrangement, operation and effect. Accordingly, for these common points a repetitive description is omitted and dissimilar points will be described. Further, the arrangements of the various parts in each of the embodiments may be combined in the light of the objects, operations and effects of the invention.

Embodiment 2

To describe the invention in more detail, the embodiment 2 will be described with reference to FIG. 4 of the attached drawings.

In FIG. 4, a pair of said assemblies 38 are installed, and these assemblies 38, 38 are removably attached to each other by a connector 40. With the arrangement thus made, a ball throwing machine 1 having four rotary wheels 7 can be easily formed. In this case, if the front one 38 of the front and rear assemblies 38, 38 has the rotary speed of the rotary wheels 7, 7 made greater than that in the rear assembly 38, high speed throwing of balls can be smoothly effected. In addition, a pair of such connectors 40, upper and lower, may be installed.

Embodiment 3

To describe the invention in more detail, the embodiment 3 will be described with reference to FIGS. 5 and 6 of the attached drawings.

In FIGS. 5 and 6, the support frame 17 for the support body main body 15 is provided with a carriage 41 to be mounted on the ground 3, and a hydraulic elevating table 42 supported on the carriage 41. The front and rear pillars 18 and 19 are supported on the elevating table 42, and a pivot shaft 44 extending substantially horizontally in a front-rear direction and having an axis 43 is pivotally supported in the upper ends of the front and rear pillars 18 and 19 in such a manner that it is turnable around the axis 43. Further, there are installed unillustrated fixing tools, such as fasteners, which make it possible to fix the pivot shaft 44 to the front and rear pillars 18 and 19 in a desired turned position around the axis 43.

The support pipe 16 extends in a left-right direction, and its lengthwise middle and the axis 43 of the pivot shaft 44 extending in a front-rear direction are orthogonal to each other, as seen in a side view (FIG. 5) and also in a plan view (FIG. 6); that is, they are three-dimensionally orthogonal to each other. Further, in this state, the support pipe 16 is supported on the front and rear pillars 18 and 19 by said pivot shaft 44. More specifically, said pivot shaft 44 is severed in the axial middle and the severed ends are directly fixed to the front and rear outer surfaces of the support pipe 16. In addition, said pivot shaft 44 may be in the form of a single shaft, with the axial intermediate portion of the pivot shaft 44 extending through the support pipe 16. And, the rotary shafts 6 are juxtaposed left and right, extending through the support pipe 16 substantially vertically.

There are installed a pair of electric motors 8 supported by the support pipe 16 for individually rotatively driving said rotary wheels 7, and a pair of operatively connecting means 9, 9, with each rotary shaft 6 being connected to the associated electric motor 8 by the associated operatively connecting means 9. The rotation speeds of the rotary wheels 7 are variable under control by the electric motors 8; thus, the rotation speeds of the two rotary wheels 7, 7 can be made different from each other.

The support shafts 16, together with the rotary shafts 6, are elevatable by the elevating table 42. Further, said rear pillar 19 is hydraulically extensible, and such extension enables the support pipe 16, rotary shafts 6, and rotary wheels 7 to be tilted to a desired angle.

According to the above arrangement, said support body main body 15 comprises a support frame 17 mountable on the ground 3, pillars 18 and 19 projecting upward from said support frame 17, and a pivot shaft 44 for pivotally supporting said support pipe 16 on the pillars 18 and 19 to allow the support pipe 16 to turn around the axis 43, wherein the support pipe 16 is three-dimensionally orthogonal to the axis 43 of said pivot shaft 44.

Therefore, turning said support pipe 16 together with said two rotary wheels 7, 7 to a desired position around the axis 43 while elevating or lowering the elevating table 42 and rear pillar 19 makes it possible to have a desired direction of throwing of balls. Further, if the rotation speeds of the two rotary wheels 7, 7 are made to differ from each other to provide a rotation to said ball 2, throwing of balls with a variety of desired pitches can be attained.

Further, the support pipe 16 is three-dimensionally orthogonal to the axis 43 of the pivot shaft 44, as described above. Therefore, the pivotal support of the support pipe 16 on the pillars 18 and 19 by the pivot shaft 44 can be made more directly than if the support pipe 16 and the pivot shaft 44 are estranged from each other to make it necessary to provide a separate joining member to join the support pipe 16 and the pivot shaft 44 to each other. In other words, the pivotal support of the support pipe 16 on the pillars 18 and 19 can be made more directly.

Thus, first, the arrangement of the ball throwing machine 1 is simplified to facilitate the formation thereof, and secondly, the pivotal support of the support pipe 16 on the support body main body 15 can be made firm, improving the strength with which the support pipe 16 is supported on the support body main body 15. Therefor, the accuracy of throwing of balls by the ball throwing machine 1 is improved.

What is claimed is:

1. A ball throwing machine comprising:

a support body (4) mountable on a ground (3);

a pair of rotary shafts (6, 6) supported by said support body (4) and rotatable around respective parallel axes (5, 5);

a pair of rotary wheels (7, 7) fixed concentrically on said rotary shafts (6,6), each of the rotary wheels (7, 7) having a respective outer peripheral surface (10, 10);

a pair of electric motors (8, 8) supported by said support body (4), the electric motors (8, 8) individually driving a rotation of a respective one of said rotary wheels (7, 7); and a pair of operatively connecting means (9, 9) individually operatively connecting a respective one of said rotary wheels (7, 7) and said rotary shafts (6, 6) to a respective one of said electric motors (8, 8), wherein said two rotary wheels (7, 7) rotate in opposite directions (C, D) in operative association with the driving of a respective one of the electric motors (8, 8) through a respective one of said operatively connecting means (9, 9) and said rotary shafts (6, 6), wherein a ball (2) fed between the outer peripheral surfaces (10, 10) of said two rotary wheels (7, 7) is nipped between the outer peripheral surfaces (10, 10) and accelerated and thrown outward, wherein said support body (4) comprises a support body main body (15) mountable on the ground (3) and a support pipe (16) supported by said support body main body (15), wherein said support body main body (15) comprises a support frame (17) mountable on the ground (3), pillars (18, 19) projecting upward from said support frame (17), and a pivot shaft (44) for pivotally supporting said support pipe (16) on the pillars (18, 19) to allow said support pipe (16) to turn around an axis (43) of said pivot shaft (44), wherein said support pipe (16) extends in a left-right direction and the axis (43) of the pivot shaft (44) extends in a front-rear direction such that the support pipe (16) and the axis (43) of said pivot shaft (44) are three-dimensionally orthogonal to each other, wherein said support pipe (16) extends linearly so as to support the rotary shafts (6, 6) in a state in which the rotary shafts (6, 6) extend through the support pipe (16) in a direction orthogonal to a longitudinal direction of the support pipe (16), wherein a first one of said rotary wheels (7) and a first one of said electric motors (8) is supported by a left portion of the support pipe (16), and a second one of said rotary wheels (7) and a second one of said electric motors (8) is supported by a right portion of the support pipe (16), wherein said operatively connecting means (9, 9) disposed outside said support pipe (16), wherein any sections of said support pipe (16) taken longitudinally thereof are rectangles of equivalent shape and size, and wherein a rotation speed of each of the rotary wheels (7, 7) are individually variable under control of a respective one of the electric motors (8, 8) such that the rotation speed of each of the rotary wheels (7, 7) can be made different from one another.

* * * * *